US012202699B2

(12) United States Patent
Koike et al.

(10) Patent No.: US 12,202,699 B2
(45) Date of Patent: Jan. 21, 2025

(54) SHEET TRANSPORTING DEVICE AND IMAGE FORMING APPARATUS

(71) Applicant: FUJIFILM BUSINESS INNOVATION CORP., Tokyo (JP)

(72) Inventors: Yoshinori Koike, Kanagawa (JP); Nobuhiro Hiroe, Kanagawa (JP); Hirotake Eguchi, Kanagawa (JP); Koji Deguchi, Kanagawa (JP); Yasunobu Goto, Kanagawa (JP); Natsumi Nakata, Kanagawa (JP); Yoshiki Matsuzaki, Kanagawa (JP); Kiyoshi Watanabe, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 192 days.

(21) Appl. No.: 17/942,574

(22) Filed: Sep. 12, 2022

(65) Prior Publication Data

US 2023/0312281 A1 Oct. 5, 2023

(30) Foreign Application Priority Data

Mar. 29, 2022 (JP) ..... 2022-052973

(51) Int. Cl.
*B65H 5/06* (2006.01)

(52) U.S. Cl.
CPC ... *B65H 5/062* (2013.01); *B65H 2301/44318* (2013.01); *B65H 2403/514* (2013.01); *B65H 2404/1441* (2013.01); *B65H 2404/152* (2013.01); *B65H 2801/06* (2013.01)

(58) Field of Classification Search
CPC ..... B65H 5/06; B65H 5/062; B65H 2402/31; B65H 2403/51; B65H 2403/511; B65H 2403/512; B65H 2403/514; B65H 2404/144; B65H 2404/1441; B65H 2404/1442; B65H 2801/06
See application file for complete search history.

(56) References Cited

U.S. PATENT DOCUMENTS 7,753,370 B2 7/2010 Inoue
2005/0067775 A1* 3/2005 Ono ..... B65H 5/062 271/272

(Continued)

FOREIGN PATENT DOCUMENTS

JP 2008-001473 A 1/2008
JP 2019-147663 A 9/2019

*Primary Examiner* — Prasad V Gokhale
(74) *Attorney, Agent, or Firm* — Oliff PLC

(57) ABSTRACT

A sheet transporting device includes: plural pairs of transporting rolls that are arranged adjacent to one another in a direction of transport of a sheet; and a component configured to switch individual positions of the plural pairs of transporting rolls between a nipping position and an unnipping position, the component being a single switching component capable of switching a state of nipping by the plural pairs of transporting rolls between a state where all of the plural pairs of transporting rolls are in the nipping position, a state where some of the plural pairs of transporting rolls are in the nipping position while remaining ones of the plural pairs of transporting rolls are in the unnipping position, and a state where all of the plural pairs of transporting rolls are in the unnipping position.

8 Claims, 9 Drawing Sheets

(56) References Cited

U.S. PATENT DOCUMENTS

| | | | | |
|---|---|---|---|---|
| 2008/0251998 | A1* | 10/2008 | Muneyasu | B65H 5/34<br>271/226 |
| 2008/0296828 | A1* | 12/2008 | Shoji | B65H 9/10<br>271/10.12 |
| 2011/0316226 | A1* | 12/2011 | Karikusa | B65H 9/06<br>271/226 |

* cited by examiner

SHEET TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2022-052973 filed Mar. 29, 2022.

BACKGROUND

(i) Technical Field

The present disclosure relates to a sheet transporting device and an image forming apparatus.

(ii) Related Art

Hitherto proposed techniques relating to sheet transporting devices include those disclosed by Japanese Unexamined Patent Application Publication No. 2008-001473 and Japanese Unexamined Patent Application Publication No. 2019-147663, for example.

The sheet transporting device disclosed by Japanese Unexamined Patent Application Publication No. 2008-001473 includes a skew correcting unit, a lateral-registration-correcting unit, and a sheet-transport-assisting unit. The skew correcting unit is configured to correct any skew of a sheet by rotating the sheet while transporting the sheet. The lateral-registration-correcting unit is provided on the downstream side relative to the skew correcting unit and is movable in a direction orthogonal to the direction of sheet transport. The lateral-registration-correcting unit is configured to correct the position of the sheet in the direction orthogonal to the direction of sheet transport. The sheet-transport-assisting unit is provided on the upstream side relative to the skew correcting unit and is movable in the direction orthogonal to the direction of sheet transport. After the skew of the sheet is corrected by the skew correcting unit, the lateral-registration-correcting unit corrects the position of the sheet by moving the sheet in the direction orthogonal to the direction of sheet transport. In this step, the sheet-transport-assisting unit operates synchronously with the lateral-registration-correcting unit in such a manner as to move in the direction in which the lateral-registration-correcting unit moves.

The sheet transporting device disclosed by Japanese Unexamined Patent Application Publication No. 2019-147663 includes two pairs of nip-transporting members that are capable of transporting a sheet while nipping the sheet and are movable in a width direction that is orthogonal to a transporting direction. The sheet transporting device moves the sheet in the width direction with the sheet being nipped by the two pairs of nip-transporting members. After the sheet is moved in the width direction, the nipping by two nip-transporting members forming one of the two pairs of nip-transporting members that is on the upstream side in the transporting direction are moved away from each other, whereby the sheet is transported by the other of the two pairs of nip-transporting members that is on the downstream side in the transporting direction.

SUMMARY

Aspects of non-limiting embodiments of the present disclosure relate to simplifying the configuration of switching the state of nipping by a plurality of pairs of transporting rolls between a nipping position and an unnipping position, compared with a case where a plurality of pairs of transporting rolls are provided with respective switching components.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet transporting device including a plurality of pairs of transporting rolls that are arranged adjacent to one another in a direction of transport of a sheet; and a component configured to switch individual positions of the plurality of pairs of transporting rolls between a nipping position and an unnipping position, the component being a single switching component capable of switching a state of nipping by the plurality of pairs of transporting rolls between a state where all of the plurality of pairs of transporting rolls are in the nipping position, a state where some of the plurality of pairs of transporting rolls are in the nipping position while remaining ones of the plurality of pairs of transporting rolls are in the unnipping position, and a state where all of the plurality of pairs of transporting rolls are in the unnipping position.

BRIEF DESCRIPTION OF THE DRAWINGS

An exemplary embodiment of the present disclosure will be described in detail based on the following figures, wherein.

DETAILED DESCRIPTION

Exemplary Embodiment

Figure 1:
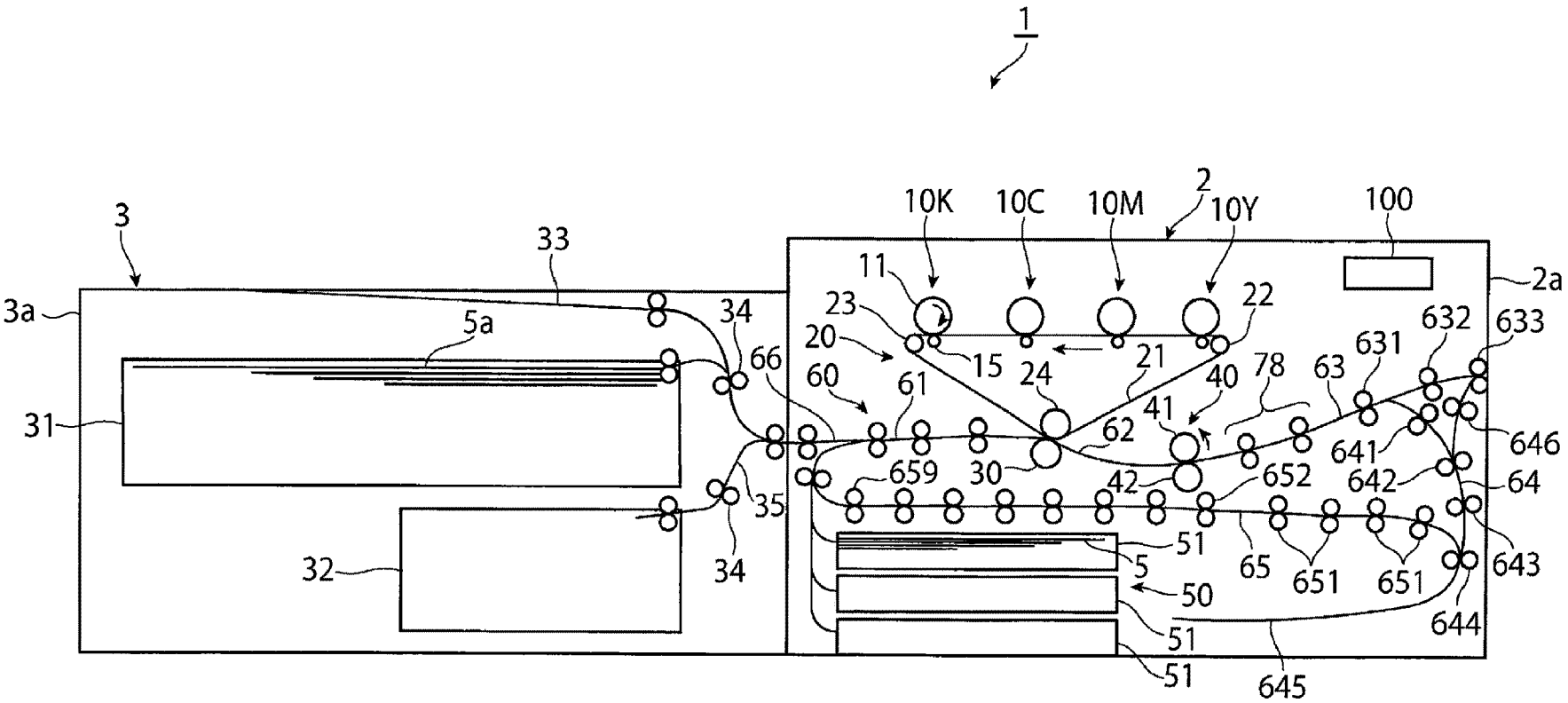
FIG. 1 illustrates an overall configuration of an image forming apparatus to which a sheet transporting device according to the exemplary embodiment of the present disclosure is applied.

FIG. 1 illustrates the entirety of an image forming apparatus 1 to which a sheet transporting device according to an exemplary embodiment of the present disclosure is applied.

Overall Configuration of Image Forming Apparatus

The image forming apparatus 1 according to the present exemplary embodiment is configured as, for example, a color printer. As illustrated in FIG. 1, the image forming apparatus 1 includes an image output device 2 and a paper feeding device 3. The image output device 2 is configured to form (output) a full-color image composed of different colors such as yellow (Y), magenta (M), cyan (C), and black (K) on recording paper 5, which is an exemplary recording medium. The paper feeding device 3 is a stand-alone device configured to feed long-size recording paper (hereinafter referred to as "long-size paper") or the like to the image output device 2. The paper feeding device 3 is located outside the image output device 2 and adjoins the image output device 2.

The image output device 2 includes a plurality of imaging devices 10, an intermediate transfer device 20, a paper feeding device 50, a fixing device 40, and a paper transporting device 60. The imaging devices 10 are configured to form toner images developed with toners contained in developers. The intermediate transfer device 20 is configured to receive the toner images formed by the imaging devices 10 and to transport the toner images to a second-transfer position, where the toner images are eventually transferred to the recording paper 5 as an exemplary recording medium in a second-transfer process. The paper feeding device 50 contains predetermined pieces of recording paper 5 to be supplied to the second-transfer position defined in the intermediate transfer device 20, and is configured to feed each of the pieces of recording paper 5. The fixing device 40 is configured to fix the toner images on the recording paper 5 having undergone the second-transfer process performed by the intermediate transfer device 20. The paper transporting device 60 is an exemplary sheet transporting device and is configured to receive the recording paper 5 from the paper feeding device 50 and transport the recording paper 5 along a predetermined transport path. The image output device 2 has a device body 2*a*. The device body 2*a* includes supporting members, exterior coverings, and so forth. A combination of the plurality of imaging devices 10, the intermediate transfer device 20, and the fixing device 40 serves as an image forming component in the present exemplary embodiment.

The imaging devices 10 are four imaging devices 10Y, 10M, 10C, and 10K, which are configured to exclusively form respective toner images in four respective colors of yellow (Y), magenta (M), cyan (C), and black (K). The four imaging devices 10 (Y, M, C, and K) are arranged in a line and at predetermined intervals in the horizontal direction in the device body 2*a*.

The four imaging devices 10 each include, for example, a photoconductor drum 11 and imaging components (not illustrated). The imaging components are provided around the photoconductor drum 11 and cooperate to form a toner image in a corresponding one of the predetermined colors on the surface of the photoconductor drum 11. Thus, the imaging devices 10 electrophotographically form respective images in the respective colors of yellow (Y), magenta (M), cyan (C), and black (K) on the surfaces of the respective photoconductor drums 11. The four imaging devices 10 are not limited to devices employing an electrophotographic method to form images and may be devices employing any other method such as an inkjet recording method or electrostatic recording method to form images in respective colors such as yellow (Y), magenta (M), cyan (C), and black (K). If the imaging devices 10 employ an inkjet recording method to form images, the intermediate transfer device 20 is omitted. In such a case, the imaging devices 10 form images directly on the recording paper 5.

As illustrated in FIG. 1, the intermediate transfer device 20 is located below the imaging devices 10 (Y, M, C, and K) for yellow (Y), magenta (M), cyan (C), and black (K) in the vertical direction. The intermediate transfer device 20 includes an intermediate transfer belt 21, a plurality of belt supporting rolls 22 to 24, and a second-transfer device 30. The intermediate transfer belt 21 is configured to rotate in the direction of the arrow in FIG. 1 in such a manner as to pass through first-transfer positions defined between the photoconductor drums 11 and respective first-transfer devices 15 (first-transfer rolls). The belt supporting rolls 22 to 24 support the intermediate transfer belt 21 from the inner side such that the intermediate transfer belt 21 is retained in a predetermined position while being allowed to rotate. The second-transfer device 30 is located on the outer peripheral surface (an image-carrying surface) of the intermediate transfer belt 21 at a position across from the belt supporting roll 24. The second-transfer device 30 is configured to transfer a set of toner images from the intermediate transfer belt 21 to the recording paper 5 in the second-transfer process.

The fixing device 40 has a housing (not illustrated) having an introduction port and a discharge port for the recording paper 5 and that houses a heating rotary member 41, a pressing rotary member 42, and so forth. The heating rotary member 41 is in the form of a roll or a belt and is configured to rotate in the direction of the arrow and to be heated by a heating component such that the surface thereof is kept at a predetermined temperature. The pressing rotary member 42 is in the form of a belt or a roll and is configured to rotate by being in contact with the heating rotary member 41 with a predetermined pressure over an area extending substantially in the axial direction of the heating rotary member 41. In the fixing device 40, the contact area where the heating rotary member 41 and the pressing rotary member 42 are in contact with each other serves as a fixing part, where a predetermined fixing process (heating and pressing) is to be performed.

As illustrated in FIG. 1, the paper feeding device 50 is located below the intermediate transfer device 20 and the second-transfer device 30. The paper feeding device 50 includes a plurality of paper containers 51 (or a single paper container 51) and delivering devices (not illustrated). The paper containers 51 each contain a stack of pieces of recording paper 5 that are of one predetermined size, kind, or the like. The delivering devices are each configured to deliver the pieces of recording paper 5 one by one from a corresponding one of the paper containers 51. The paper containers 51 are each drawable from, for example, the front face of the device body 2*a* (the face toward which the user who is operating the image output device 2 faces).

The stand-alone paper feeding device 3 includes a paper container 31 and a large-capacity paper container 32. The paper container 31 contains a stack of pieces of long-size paper 5*a*. The long-size paper 5*a* has a greater length in a direction of paper feeding and/or a direction intersecting the direction of paper feeding than the recording paper 5 of size A3, which is the largest one of standard sizes typically handled by the image forming apparatus 1. The large-capacity paper container 32 contains a greater number of pieces of recording paper 5 of a standard size than the paper containers 51, which are typically used. The paper feeding device 3 further includes a paper tray 33, which is provided at the top of a device body 3*a* and is intended for manual feeding of the long-size paper 5*a* or the like.

The paper transporting device 60 includes a paper feeding path 61, an intermediate transport path 62, an outputting transport path 63, a reversal transport path 64, and a duplex transport path 65. Recording paper 5 fed from the paper feeding device 50 is transported along the paper feeding path 61 to the second-transfer position. The recording paper 5 having received a set of toner images at the second-transfer position in the second-transfer process is transported along the intermediate transport path 62 to the fixing device 40. The recording paper 5 having the set of toner images fixed by the fixing device 40 is transported along the outputting transport path 63 to a paper receiving member (not illustrated) or is reversed, before being outputted, by being transported along the reversal transport path 64. The recording paper 5 having been reversed in the reversal transport path 64 is transported along the duplex transport path 65 to the paper feeding path 61 again for an image forming process to be performed on the other side of the recording paper 5. Details of the paper transporting device 60 will be described separately below.

The stand-alone paper feeding device 3 includes a paper feeding path 35, which is provided with pairs of paper transporting rolls 34. The long-size paper 5*a* or recording paper 5 that is fed from the paper container 31, the large-capacity paper container 32, or the manual-feeding paper tray 33 is transported by the pairs of paper transporting rolls 34 to an external-paper transport path 66, which is provided in the image output device 2.

An overall operation of the image forming apparatus 1 inclusive of the paper feeding device 3 is controlled by a control device 100, illustrated in FIG. 1.

Basic Operation of Image Forming Apparatus

A basic image forming operation performed by the image forming apparatus 1 will now be described.

The following description relates to an image forming operation in which a full-color image composed of toner images having the four respective colors (Y, M, C, and K) is formed by using the four imaging devices 10 (Y, M, C, and K).

When the control device 100 of the image forming apparatus 1 receives a command that requests an image forming operation (printing operation), the control device 100 activates the four imaging devices 10 (Y, M, C, and K), the intermediate transfer device 20, the second-transfer device 30, the fixing device 40, the paper feeding device 50, the paper transporting device 60, and other relevant devices.

First, in the imaging devices 10 (Y, M, C, and K), toner images in the respective colors of yellow (Y), magenta (M), cyan (C), and black (K) are formed on the respective photoconductor drums 11. The toner images in the respective colors thus formed on the photoconductor drums 11 of the imaging devices 10 (Y, M, C, and K) are carried to the respective first-transfer positions, where the first-transfer devices 15 perform a first-transfer process, in which the toner images in the respective colors are sequentially superposed one on top of another on the intermediate transfer belt 21 of the intermediate transfer device 20 that is rotating in the direction of the arrow.

Subsequently, in the intermediate transfer device 20, the intermediate transfer belt 21 having received the set of toner images in the first-transfer process rotates to transport the set of toner images to the second-transfer position. Meanwhile, in the paper feeding device 50, a predetermined piece of recording paper 5 is fed into the paper feeding path 61 synchronously with the imaging process. In the paper feeding path 61, the piece of recording paper 5 is supplied to the second-transfer position synchronously with the timing of transfer.

At the second-transfer position defined in the intermediate transfer device 20, a second-transfer roll 30 performs the second-transfer process in which the set of toner images is transferred from the intermediate transfer belt 21 to the piece of recording paper 5. The piece of recording paper 5 now having the set of toner images received in the second-transfer process is released from the intermediate transfer belt 21 and the second-transfer roll 30, and is transported to the fixing device 40. In the fixing device 40, the piece of recording paper 5 having undergone the second-transfer process is made to pass through the fixing part defined between the heating rotary member 41 and the pressing rotary member 42 that are rotating. Thus, the predetermined fixing process (heating and pressing) is performed on the set of unfixed toner images, whereby the set of toner images are fixed to the piece of recording paper 5. The piece of recording paper 5 having undergone the fixing process is transported along the outputting transport path 63 to, for example, the paper receiving member (not illustrated) provided on the outside of the image output device 2.

If images are to be formed on the two respective sides of recording paper 5, the recording paper 5 having an image on one side thereof is not immediately discharged to the paper receiving member (not illustrated) through the outputting transport path 63 but is redirected toward the reversal transport path 64 by a redirecting component (not illustrated). As the recording paper 5 is transported along the reversal transport path 64, the front and back sides of the recording paper 5 are reversed. Then, the recording paper 5 is transported along the duplex transport path 65 to the paper feeding path 61 again for the operation of forming an image on the back side of the recording paper 5.

If an image is to be formed on one side or each of the two sides of long-size paper 5*a* or the like to be fed from the external paper feeding device 3, the paper feeding device 3 operates as follows. Recording paper 5, such as long-size paper 5*a*, is fed to the paper feeding path 35 synchronously with the imaging process and is transported along the paper feeding path 35 to the external-paper transport path 66 provided in the image output device 2.

Through the above series of processes, recording paper 5 having a full-color image formed as a combination of toner images in the four respective colors is obtained.

Configuration of Sheet Transporting Device

Figure 2:
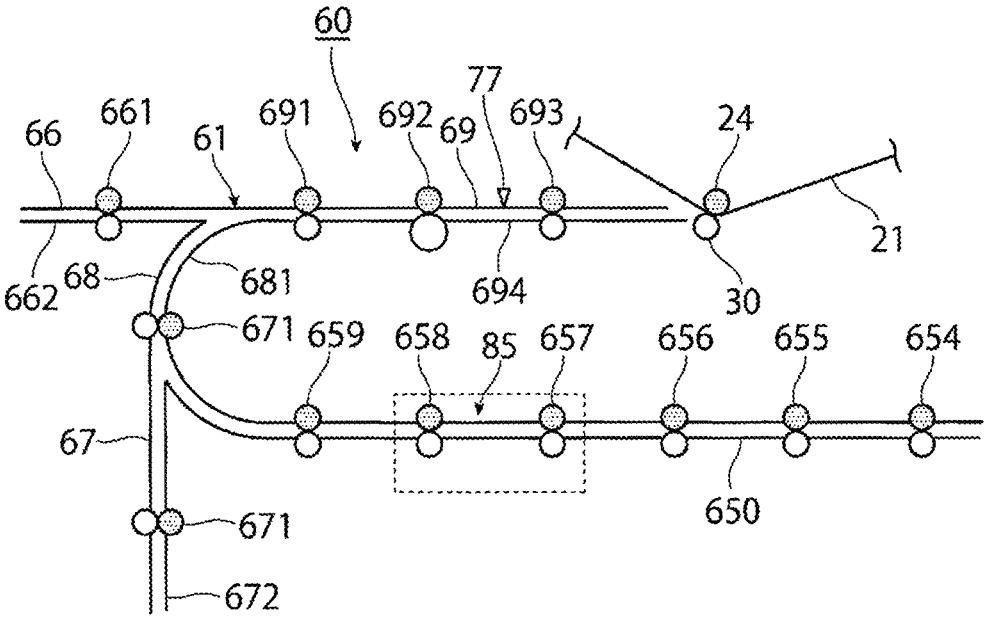
FIG. 2 illustrates a configuration of a relevant part of a paper transporting device serving as an exemplary sheet transporting device according to the exemplary embodiment of the present disclosure.

FIGS. 1 and 2 illustrate the configuration of the image forming apparatus to which the paper transporting device 60 serving as an exemplary sheet transporting device according to the exemplary embodiment of the present disclosure is applied.

The paper transporting device 60 according to the present exemplary embodiment is provided inside the device body 2*a* of the image output device 2. As illustrated in FIG. 1, the paper transporting device 60 includes the paper feeding path 61, the intermediate transport path 62, the outputting transport path 63, the reversal transport path 64, the duplex transport path 65, and the external-paper transport path 66. Recording paper 5 fed from the paper feeding device 50 is transported along the paper feeding path 61 to the second-transfer position defined in the intermediate transfer device 20. The recording paper 5 having received a set of toner images at the second-transfer position in the intermediate transfer device 20 is transported along the intermediate transport path 62 to the fixing device 40. The recording paper 5 having the set of toner images fixed by the fixing device 40 is transported along the outputting transport path 63 to the paper receiving member (not illustrated) or is reversed, before being outputted, by being transported along the reversal transport path 64. The recording paper 5 having been reversed in the reversal transport path 64 is transported along the duplex transport path 65 and the paper feeding path 61 to the second-transfer position defined in the intermediate transfer device 20 again. On the other hand, recording paper 5, such as long-size paper 5*a*, fed from the external paper feeding device 3 is transported along the external-paper transport path 66, which is a short path, to the paper feeding path 61.

As illustrated in FIG. 2, the paper feeding path 61 includes a vertical transport path 67, a curved transport path 68, and a horizontal transport path 69. The vertical transport path 67 extends vertically in such a manner as to allow the recording paper 5 fed from the paper feeding device 50 to be transported upward in the vertical direction. In the curved transport path 68, the recording paper 5 transported upward in the vertical direction along the vertical transport path 67 is redirected to be transported in the horizontal direction. The recording paper 5 redirected along the curved transport path 68 to be transported in the horizontal direction is transported along the horizontal transport path 69 to the second-transfer position defined in the intermediate transfer device 20.

The vertical transport path 67 included in the paper feeding path 61 is provided with pairs of paper transporting rolls 671 and a guide member 672. The recording paper 5 is transported by the pairs of paper transporting rolls 671 while being guided on the front and back sides thereof by the guide member 672. The curved transport path 68 included in the paper feeding path 61 is provided with a curved guide member 681, which guides the front and back sides of the recording paper 5.

The horizontal transport path 69 included in the paper feeding path 61 is provided with a plurality (three in the case illustrated in the drawings) of pairs of paper transporting rolls 691 to 693 and a guide member 694. The recording paper 5 is transported by the pairs of paper transporting rolls 691 to 693 while being nipped by the pairs of paper transporting rolls 691 to 693 and being guided on the front and back sides thereof by the guide member 694. Among the three pairs of paper transporting rolls 691 to 693, the pair of paper transporting rolls 693 located at the downstreammost position and immediately before the second-transfer position defined in the intermediate transfer device 20 serves as a pair of first shift rolls configured to cause the recording paper 5 to undergo a translational movement (to be shifted) in a scanning direction that intersects the direction of transport of the recording paper 5.

Figure 3:
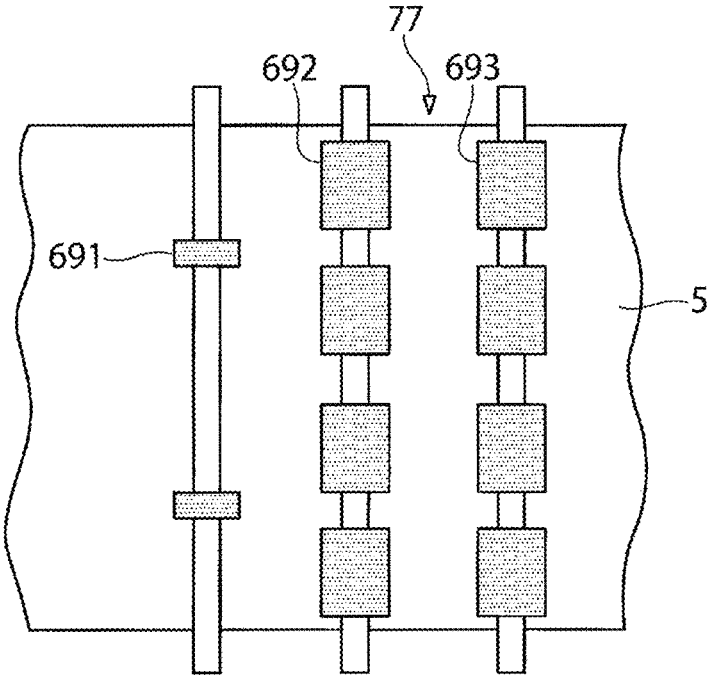
FIG. 3 is a plan view of pairs of paper transporting rolls.
Figure 4:
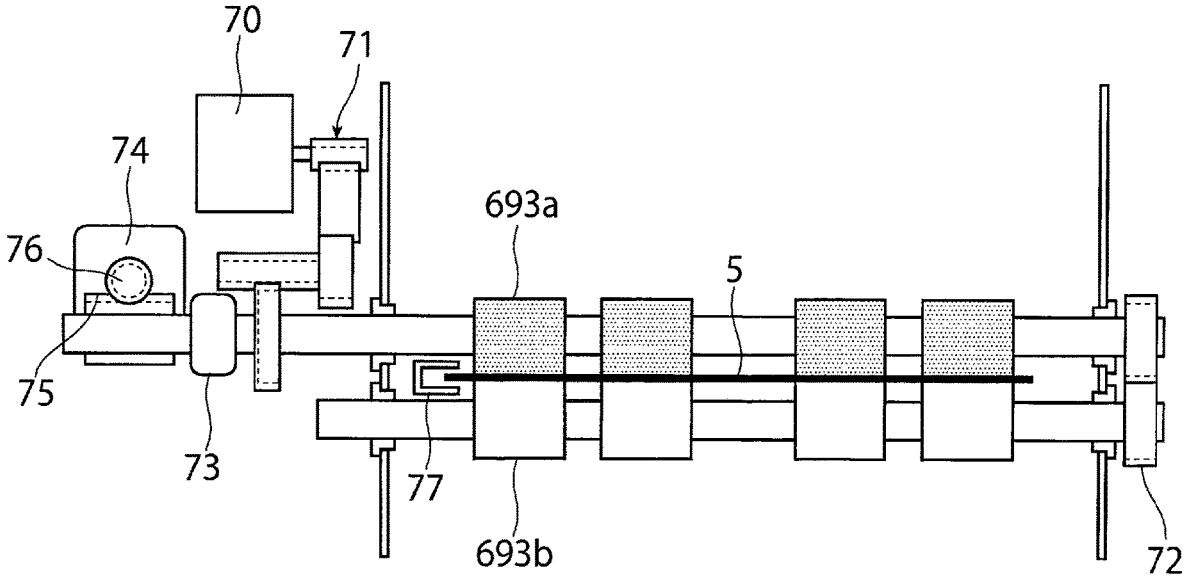
FIG. 4 is a sectional view of one of the pairs of paper transporting rolls and relevant elements.

Referring to FIGS. 3 and 4, the pair of paper transporting rolls 693 serving as the pair of first shift rolls includes a driving roll 693*a* and a follower roll 693*b*. The driving roll 693*a* is rotated by a driving motor 70 through a reduction gear train 71. The follower roll 693*b* receives a driving force from the driving roll 693*a* through a transmitting gear 72 and is pressed against the driving roll 693*a*. The driving roll 693*a* is provided at one end in the axial direction thereof with a bearing 73. The driving roll 693*a* is movable together with the follower roll 693*b* in the axial direction thereof by a moving mechanism that includes a driving motor 74, a rack 75, and a pinion 76. The movable range of the driving roll 693*a* in the thrust direction is restricted by the bearing 73. A first detector 77 is provided on the upstream side relative to the pair of paper transporting rolls 693 in the direction of transport of the recording paper 5. The first detector 77 is an in-line sensor or the like and is configured to detect the position of the leading end of the recording paper 5 that extends in a direction intersecting the direction of transport of the recording paper 5.

Among the three pairs of paper transporting rolls 691 to 693, the pair of paper transporting rolls 692 located on the upstream side relative to the pair of paper transporting rolls 693 serves as a pair of registration rolls configured to adjust the timing of transport of the recording paper 5 to the second-transfer position. Among the three pairs of paper transporting rolls 691 to 693, the pair of paper transporting rolls 691 located at the upstreammost position cooperates with the other pairs of paper transporting rolls 692 and 693 to transport the recording paper 5.

When the pair of paper transporting rolls 693 serving as the pair of first shift rolls adjusts the position of the recording paper 5 in the scanning direction intersecting the direction of transport of the recording paper 5, the nipping of the recording paper 5 by the pairs of paper transporting rolls other than the pair of transporting rolls 693 is disabled.

Referring to FIG. 1, the intermediate transport path 62 is provided for transporting the recording paper 5 having a set of unfixed toner images and is provided with a plurality of or a single transporting belt or the like (not illustrated), with which the recording paper 5 is transported to the fixing device 40. On the downstream side relative to the fixing device 40 in the direction of transport is provided a decurling device 78, which is configured to decurl the recording paper 5.

The outputting transport path 63 is provided with a plurality (three in the case illustrated in the drawings) of pairs of paper outputting rolls 631 to 633, with which the recording paper 5 having undergone the fixing process performed by the fixing device 40 is immediately discharged to the outside.

Among the three pairs of paper outputting rolls 631 to 633 provided to the outputting transport path 63, the pair of paper outputting rolls 631 is located at the upstreammost position in the direction of transport of the recording paper 5. On the downstream side relative to the pair of paper outputting rolls 631 are provided a plurality of pairs of paper transporting rolls 641 to 644. The recording paper 5 is redirected toward the reversal transport path 64 by a redirecting component (not illustrated) configured to change the direction of transport of the recording paper 5 and is transported along the reversal transport path 64 by the pairs of paper transporting rolls 641 to 644. The reversal transport path 64 extends toward the downstream side in the direction of transport by the plurality of pairs of paper transporting rolls 641 to 644 and further extends below the duplex transport path 65 to form an end portion 645. The direction of rotation of the plurality of pairs of paper transporting rolls 642 to 644 provided to the reversal transport path 64 is switchable between the forward direction and the backward direction. When the recording paper 5 is temporarily transported into the reversal transport path 64 and the plurality of pairs of paper transporting rolls 642 to 644 are then rotated backward, the recording paper 5 is discharged from the reversal transport path 64 by the pair of output rolls 646 to the paper receiving member (not illustrated) with the front and back sides thereof reversed.

On the other hand, when the recording paper 5 is temporarily transported into the reversal transport path 64 and the pair of paper transporting rolls 644 is then rotated backward, the recording paper 5 is redirected by a redirecting component (not illustrated) toward the duplex transport path 65.

As illustrated in FIGS. 1 and 2, the duplex transport path 65 is provided with a plurality of pairs of paper transporting rolls 651 to 659 and a guide member 650. The recording paper 5 is transported by the pairs of paper transporting rolls 651 to 659 while being guided on the front and back sides thereof by the guide member 650. Among the plurality of pairs of paper transporting rolls 651 to 659, the pair of paper transporting rolls 659 located at the downstreammost position and immediately before the paper feeding path 61 serves as a pair of second shift rolls configured to cause the recording paper 5 to undergo a translational movement (to be shifted) in the scanning direction intersecting the direction of transport of the recording paper 5.

Figure 5:
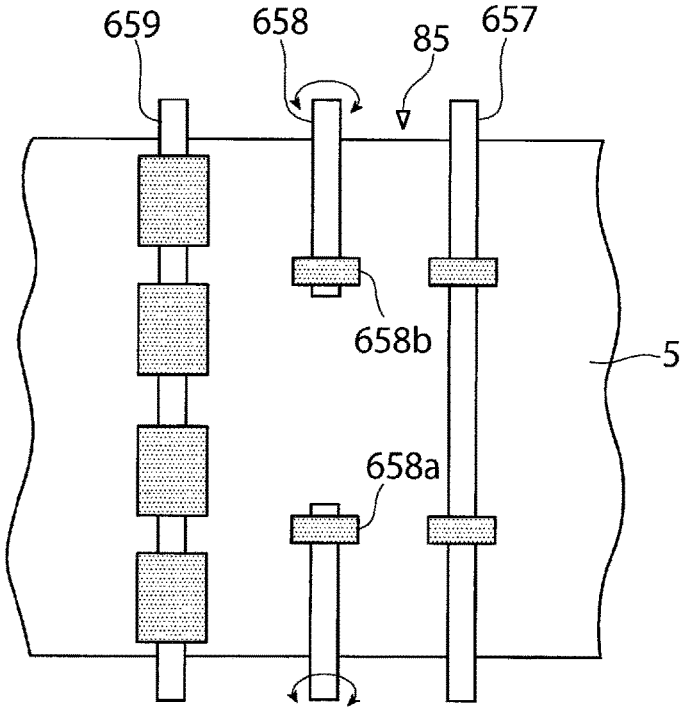
FIG. 5 is a plan view of other pairs of paper transporting rolls.
Figure 6:
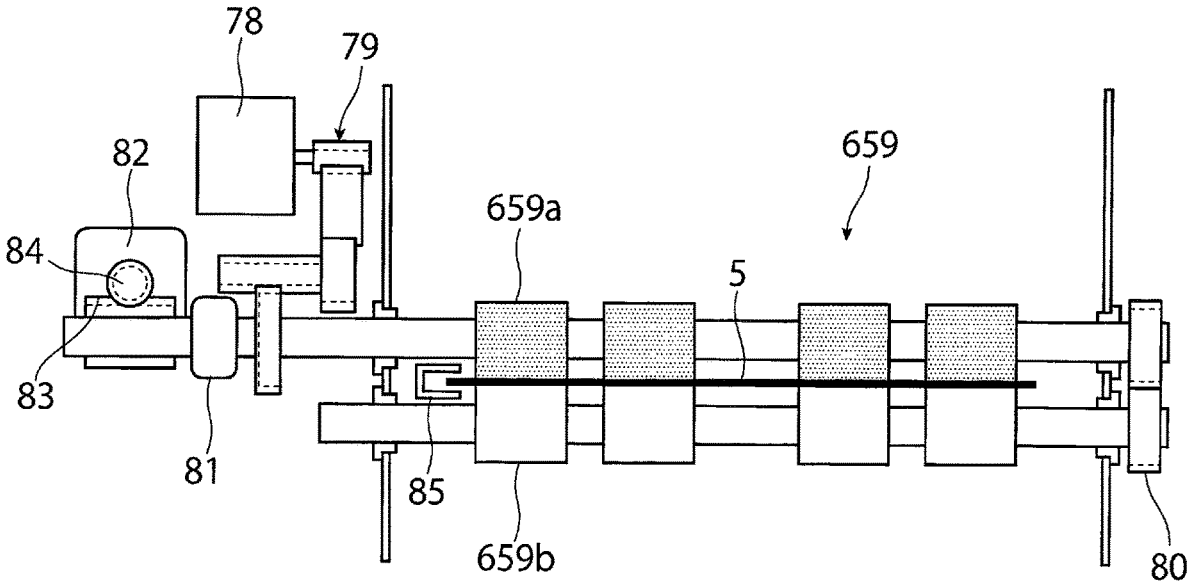
FIG. 6 is a sectional view of one of the pairs of paper transporting rolls and relevant elements.

Referring to FIGS. 5 and 6, the pair of paper transporting rolls 659 serving as the pair of second shift rolls has the same configuration as the pair of paper transporting rolls 693 serving as the pair of first shift rolls. Specifically, the pair of paper transporting rolls 659 serving as the pair of second shift rolls includes a driving roll 659*a* and a follower roll 659*b*. The driving roll 659*a* is rotated by a driving motor 78 through a reduction gear train 79. The follower roll 659*b* receives a driving force from the driving roll 659*a* through a transmitting gear 80 and is pressed against the driving roll 659*a*. The driving roll 659*a* is provided at one end in the axial direction thereof with a bearing 81. The driving roll 659*a* is movable together with the follower roll 659*b* in the axial direction thereof by a moving mechanism that includes a driving motor 82, a rack 83, and a pinion 84. The movable range of the driving roll 659*a* in the thrust direction is restricted by the bearing 81.

Among the three pairs of paper transporting rolls 657 to 659, the pair of paper transporting rolls 658 located on the upstream side relative to the pair of paper transporting rolls 659 serves as a pair of skew correcting rolls configured to correct any skew of the recording paper 5. The pair of paper transporting rolls 658 includes a first driving roll 658*a* and a second driving roll 658*b*, which are separate from each other. The first driving roll 658*a* is located on the front side in the axial direction. The second driving roll 658*b* is located on the rear side in the axial direction. The directions and amounts of rotation of the first driving roll 658*a* and the second driving roll 658*b* are controllable independently of each other. The pair of paper transporting rolls 658 further includes on the lower side thereof a follower roll 658*c*, which extends continuously and includes a plurality of subrolls arranged side by side in the axial direction.

The pair of paper transporting rolls 658 is configured to correct any skew of the recording paper 5 by changing the individual amounts and directions of rotation of the first driving roll 658*a* and the second driving roll 658*b* while nipping the recording paper 5.

A second detector 85 is provided on the upstream side relative to the pair of paper transporting rolls 658 in the direction of transport of the recording paper 5. The second detector 85 is an in-line sensor or the like and is configured to detect the position of the leading end of the recording paper 5 that extends in a direction intersecting the direction of transport of the recording paper 5. The second detector 85 outputs a detection signal to the control device 100.

Among the three pairs of paper transporting rolls 657 to 659, the pair of paper transporting rolls 657 located at the upstreammost position cooperates with the pairs of paper transporting rolls 651 to 656 and others to transport the recording paper 5.

Referring to FIG. 2, the external-paper transport path 66 is provided with a pair of paper transporting rolls 661 and a guide member 662. The recording paper 5 supplied from the external paper feeding device 3 is transported by the pair of paper transporting rolls 661 while being nipped by the pair of paper transporting rolls 661 and being guided on the front and back sides thereof by the guide member 662.

The image forming apparatus 1 to which the paper transporting device 60 configured as above is applied is capable of forming an image on the long-size paper 5*a* that is fed from the external paper feeding device 3 or the like. The long-size paper 5*a*, which is exemplary recording paper 5, is longer than standard-size paper in the direction of transport and is therefore more likely to skew relative to the direction of transport while being transported in the paper transporting device 60. The long-size paper 5*a* is more likely to skew than the standard recording paper 5 particularly in the process of forming images on the two sides thereof. In such a case, the long-size paper 5*a* having an image on one side thereof is to be transported from the outputting transport path 63 and along the reversal transport path 64 for the reversal of the front and back sides thereof, and to be further transported along the duplex transport path 65 and the paper feeding path 61 to the second-transfer position in the intermediate transfer device 20. That is, the path along which the recording paper 5 is to be transported is very long.

Therefore, as illustrated in FIG. 2, the paper transporting device 60 according to the present exemplary embodiment includes, as described above, the pair of paper transporting rolls 659 serving as the pair of second shift rolls, the pair of paper transporting rolls 658 serving as the pair of skew correcting rolls, and the pair of paper transporting rolls 657 in an area of the duplex transport path 65 that is at the downstreammost position in the direction of transport of the recording paper 5. The pair of paper transporting rolls 659 serving as the pair of second shift rolls corrects the position of the recording paper 5 in the direction intersecting the direction of transport by causing the recording paper 5 to undergo a translational movement after any skew of the recording paper 5 is corrected by the pair of paper transporting rolls 658.

In the paper transporting device 60, while the pair of paper transporting rolls 657 is transporting the long-size paper 5*a* by a predetermined length, the second detector 85 detects the position of the leading end of the long-size paper 5*a* and calculates the amount of skew of the long-size paper 5*a*.

If the control device 100 receives a detection signal representing that the long-size paper 5*a* is skewed, the nipping of the long-size paper 5*a* by the pair of paper transporting rolls 659 and 657 and relevant elements is to be disabled first. Then, the skew of the long-size paper 5*a* is to be corrected by the pair of paper transporting rolls 658 serving as the pair of skew correcting rolls. Furthermore, the position of the long-size paper 5*a* in the direction intersecting the direction of transport is to be corrected by the pair of paper transporting rolls 659 serving as the pair of second shift rolls, before the long-size paper 5*a* is transported by the pair of paper transporting rolls 659 and others.

Therefore, in the paper transporting device 60, the state of nipping by the pair of paper transporting rolls 658 serving as the pair of skew correcting rolls and the pair of paper transporting rolls 657 located on the upstream side relative to and adjacent to the pair of paper transporting rolls 658 is to be switched between a first state of nipping where both of the two are in a nipping position, a second state of nipping where only the pair of paper transporting rolls 658 serving as the pair of skew correcting rolls is in the nipping position while the pair of paper transporting rolls 657 is in an unnipping position established when the nipping is disabled, and a third state of nipping where both the pair of paper transporting rolls 658 and the pair of paper transporting rolls 657 are in the unnipping position.

The related-art paper transporting devices have a technical problem in that since the pairs of paper transporting rolls equivalent to the pairs of paper transporting rolls 658 and 657 are provided with respective mechanisms of disabling the nipping, the configurations of the paper transporting devices are complicated, leading to an increase in the size and cost of the devices.

In such a respect, the paper transporting device 60 according to the present exemplary embodiment includes a plurality of pairs of transporting rolls that are arranged adjacent to one another in the direction of transport of the sheet; and a component configured to switch the individual positions of the plurality of pairs of transporting rolls between a nipping position and an unnipping position. The component is a single switching component capable of switching the state of nipping by the plurality of pairs of transporting rolls between a state where all of the plurality of pairs of transporting rolls are in the nipping position, a state where some of the plurality of pairs of transporting rolls are in the nipping position while the remaining ones are in the unnipping position, and a state where all of the plurality of pairs of transporting rolls are in the unnipping position.

Figure 7:
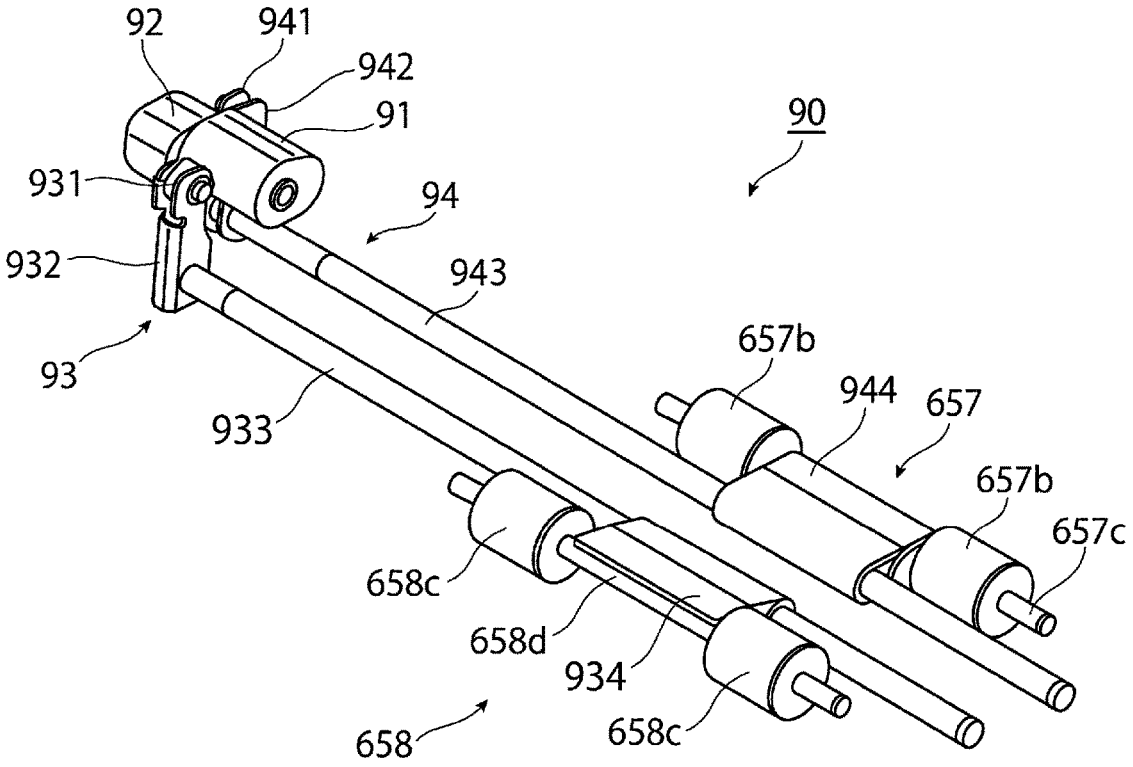
FIG. 7 is a perspective view of a switching mechanism provided for two of the pairs of paper transporting rolls.

Specifically, referring to FIG. 7, the paper transporting device 60 according to the present exemplary embodiment includes a switching mechanism 90, which serves as an exemplary single switching component configured to switch the state of nipping by the pair of paper transporting rolls 658 and the pair of paper transporting rolls 657. The switching mechanism 90 is located on one axial-direction side (rear side) of the pair of paper transporting rolls 658 and the pair of paper transporting rolls 657.

The switching mechanism 90 includes first and second eccentric cams 91 and 92, and first and second transmission mechanisms 93 and 94. The first and second eccentric cams 91 and 92 are rotated by a driving motor (not illustrated). The first and second transmission mechanisms 93 and 94 are each configured to change the state of nipping of a corresponding one of the pair of paper transporting rolls 658 and the pair of paper transporting rolls 657 by transmitting the movement of a corresponding one of the first and second eccentric cams 91 and 92 thereto.

The first transmission mechanism 93 includes a first cam follower 931, which follows the first eccentric cam 91; a first acting arm 932, at one end of which the first cam follower 931 is attached; a first driving shaft 933, which transmits an inclining motion of the first acting arm 932 to the pair of paper transporting rolls 658; and a first switching plate 934, which is fixed to the first driving shaft 933 and is configured to switch the position of the pair of paper transporting rolls 658 between the nipping position and the unnipping position by pushing down the rotating shaft, 658*d*, of the follower roll 658*c*. The second transmission mechanism 94 includes a second cam follower 941, which follows the second eccentric cam 92; a second acting arm 942, at one end of which the second cam follower 941 is attached; a second driving shaft 943, which transmits an inclining motion of the second acting arm 942 to the pair of paper transporting rolls 657; and a second switching plate 944, which is fixed to the second driving shaft 943 and is configured to switch the position of the pair of paper transporting rolls 657 between the nipping position and the unnipping position by pushing down the rotating shaft, 657*c*, of a follower roll 657*b*.

Figure 8:
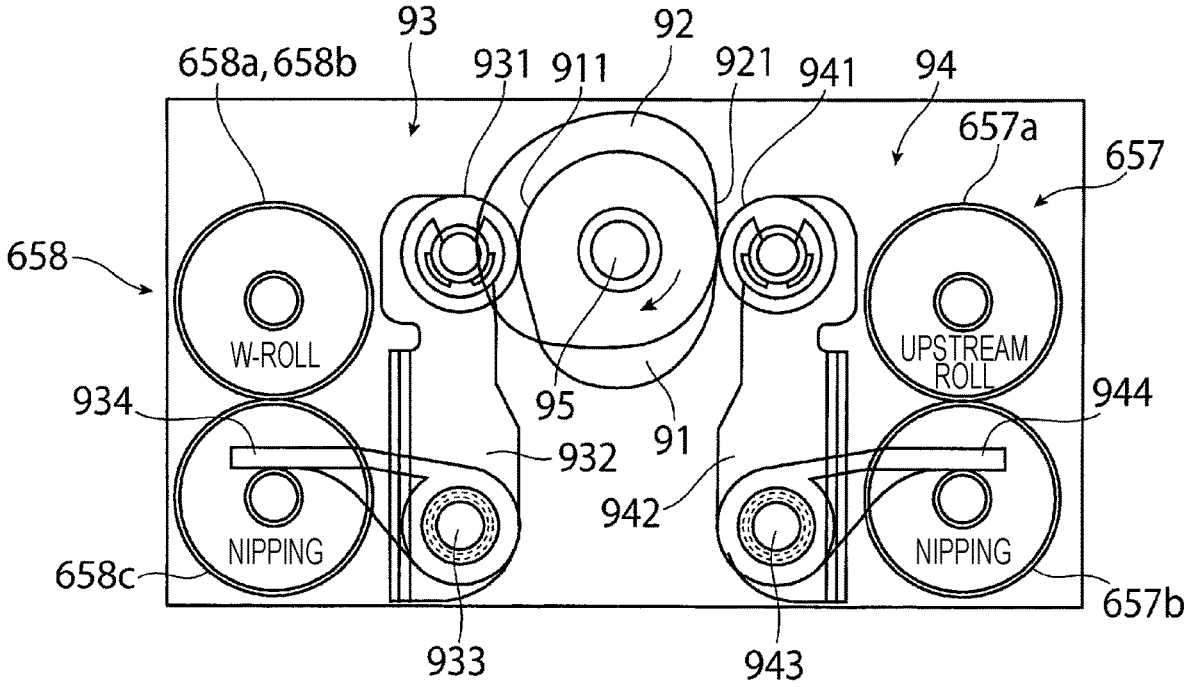
FIG. 8 is a sectional view of the switching mechanism provided for the two of the pairs of paper transporting rolls.
Figure 9:
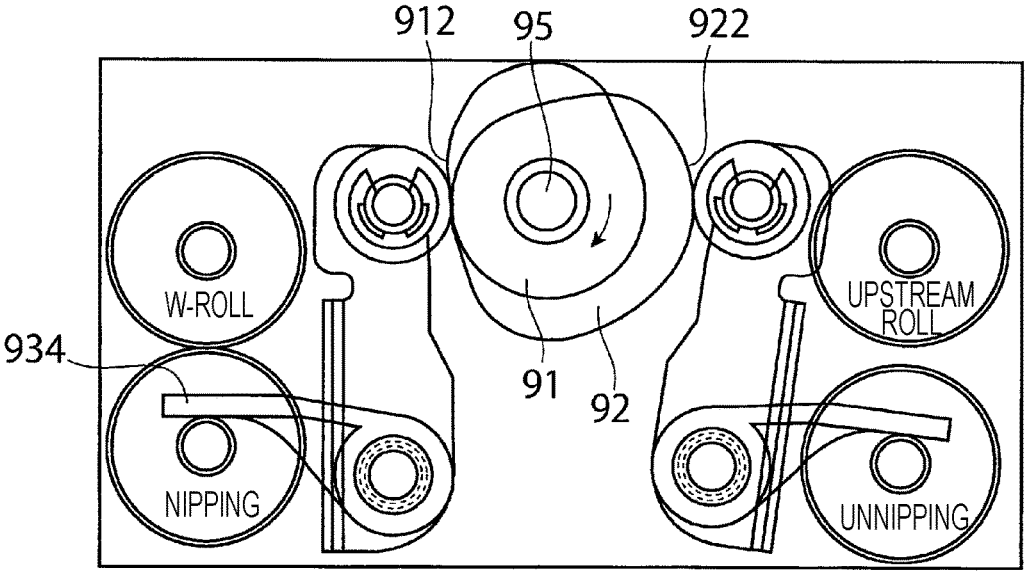
FIG. 9 is another sectional view of the switching mechanism provided for the two of the pairs of paper transporting rolls.
Figure 10:
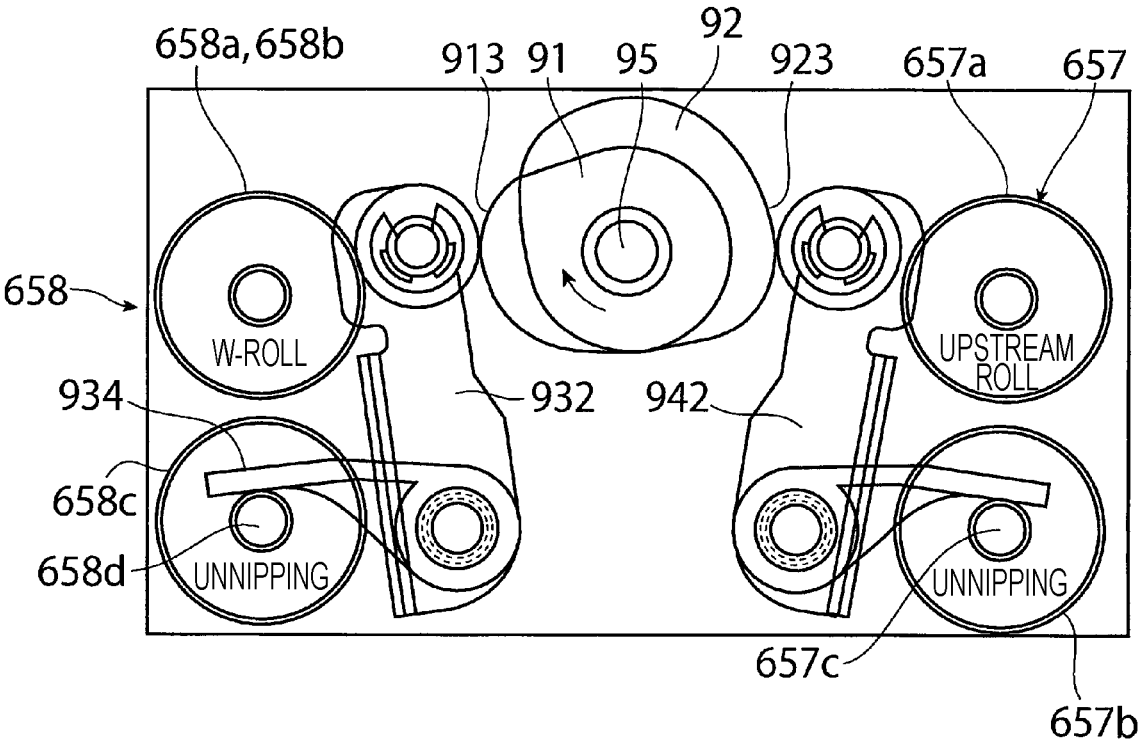
FIG. 10 is yet another sectional view of the switching mechanism provided for the two of the pairs of paper transporting rolls.

Referring to FIG. 8, the first and second eccentric cams 91 and 92 are provided coaxially on a driving shaft 95. The direction and amount of rotation of the driving shaft 95 are changed by the driving motor (not illustrated). The first and second eccentric cams 91 and 92 include respective first eccentric portions 911 and 921, respective second eccentric portions 912 and 922, and respective third eccentric portions 913 and 923. The first eccentric portions 911 and 921 cause the respective follower rolls 658*c* and 657*b* of the pairs of paper transporting rolls 658 and 657 to be pressed against the driving rolls 658*a* and 658*b* and the driving roll 657*a* to form respective nips. Referring to FIG. 9, the second eccentric portion 912 causes the follower roll 658*c* of the pair of paper transporting rolls 658 to be pressed against the driving rolls 658*a* and 658*b* to form nips, while the second eccentric portion 922 causes the follower roll 657*b* of the pair of paper transporting rolls 657 to move away from the driving roll 657*a* to disable the nipping. Referring to FIG. 10, the third eccentric portions 913 and 923 cause the respective follower rolls 658*c* and 657*b* of the pairs of paper transporting rolls 658 and 657 to move away from the driving rolls 658*a* and 658*b* and the driving roll 657*a* to disable the nipping. The first to third eccentric portions 911 to 913 are continuous with one another to form a smooth curve as a whole. The first to third eccentric portions 921 to 923 are continuous with one another to form a smooth curve as a whole.

The first and second cam followers 931 and 941 are positioned in contact with the first and second eccentric cams 91 and 92, respectively. The first and second cam followers 931 and 941 each have a cylindrical shape and are each rotatably attached to one end of a corresponding one of the first and second acting arms 932 and 942. The first and second acting arms 932 and 942 are each attached to one end of a corresponding one of the first and second driving shafts 933 and 943 in such a manner as to be rotatable on the first and second driving shafts 933 and 943. The first and second driving shafts 933 and 943 each extend in the axial direction of the pairs of paper transporting rolls 658 and 657 from the rear side toward the front side of the device body 2*a* and are rotatably supported.

The first and second switching plates 934 and 944 are fixed to respective distal portions of the first and second driving shafts 933 and 943. Thus, the first and second switching plates 934 and 944 move the follower rolls 658*c* and 657*b* of the pairs of paper transporting rolls 658 and 657 away from the driving rolls 658*a* and 658*b* and the driving roll 657*a* to disable the nipping.

Functions of Paper Transporting Device

Figure 11A:
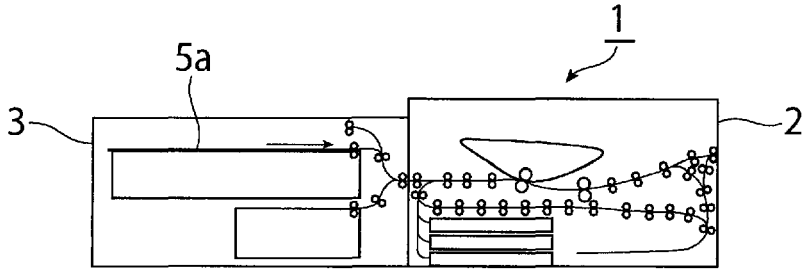
FIGS. 11A to 11H illustrate how long-size paper is transported in the image forming apparatus to which the sheet transporting device according to the exemplary embodiment of the present disclosure is applied.
Figure 11B:
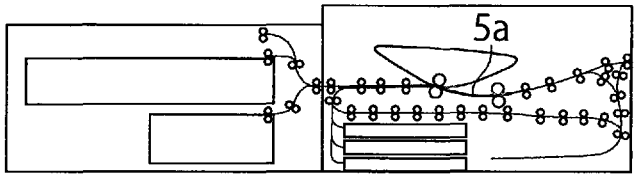
Figure 11C:
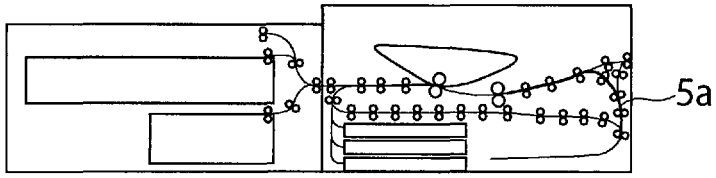
Figure 11D:
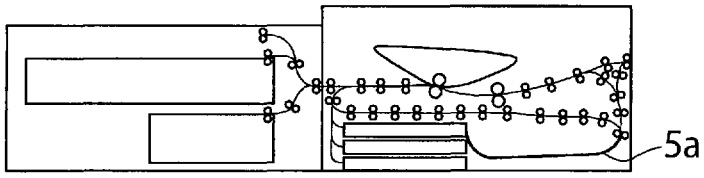
Figure 11E:
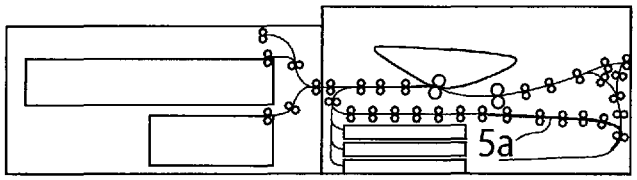
Figure 11F:
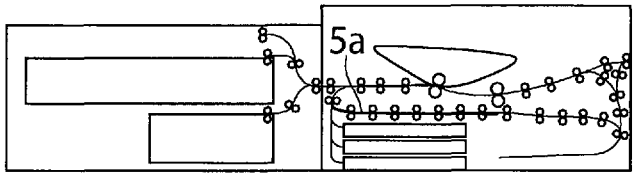
Figure 11G:
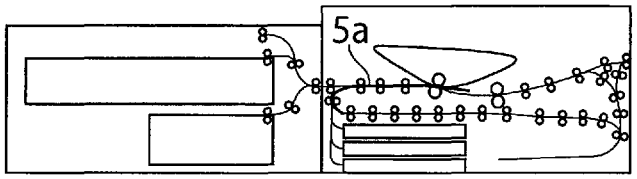
Figure 11H:
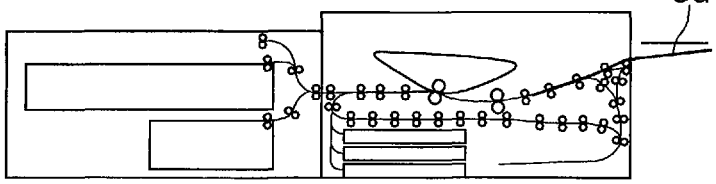

According to the present exemplary embodiment, in the process of forming images on the two respective sides of long-size paper 5*a*, the long-size paper 5*a* is fed from the paper feeding device 3 to the paper transporting device 60 as illustrated in FIG. 11A.

The long-size paper 5*a* fed from the paper feeding device 3 enters the image output device 2 and is transported along the external-paper transport path 66 and the paper feeding path 61 in the paper transporting device 60 to the second-transfer position defined in the intermediate transfer device 20. In this process, referring to FIG. 2, the position of the long-size paper 5*a* in the direction intersecting the direction of transport is detected by the first detector 77 located on the upstream side relative to the pair of paper transporting rolls 693. If any displacement is detected in the position of the long-size paper 5*a* in the direction intersecting the direction of transport, the position of the long-size paper 5*a* is adjusted by the pair of paper transporting rolls 693, illustrated in FIG. 4.

Subsequently, an image is formed and fixed on one side of the long-size paper 5*a*. Then, as illustrated in FIGS. 11C to 11F, the long-size paper 5*a* is reversed by being transported along the outputting transport path 63 and the reversal transport path 64 and is transported to the duplex transport path 65.

Figure 12:
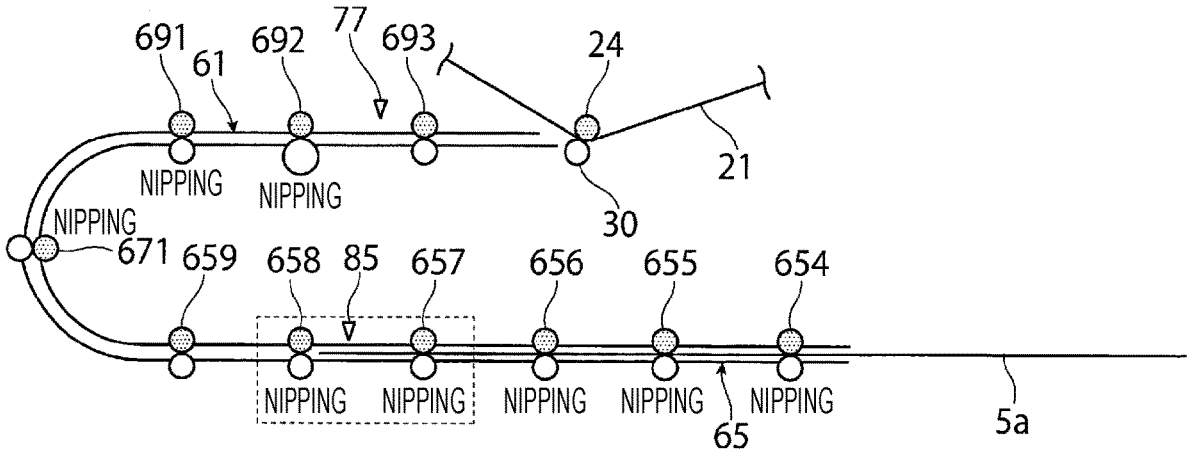
FIG. 12 illustrates a state of transport of the long-size paper in the paper transporting device according to the exemplary embodiment of the present disclosure.

The long-size paper 5*a* transported to the duplex transport path 65 is further transported to the pair of paper transporting rolls 657 and the pair of paper transporting rolls 658, as illustrated in FIG. 12.

In this state, as illustrated in FIG. 8, the first eccentric portions 911 and 921 of the first and second eccentric cams 91 and 92 are positioned in contact with the first and second cam followers 931 and 941. Therefore, the pair of paper transporting rolls 657 and the pair of paper transporting rolls 658 are both in the nipping position.

Subsequently, the control device 100 controls the pair of paper transporting rolls 657 and the pair of paper transporting rolls 658 and causes the second detector 85 to detect the amount of skew of the long-size paper 5*a*.

If any skew of the long-size paper 5*a* is detected by the second detector 85, the control device 100 corrects the skew of the long-size paper 5*a* by controlling the pair of paper transporting rolls 658 with reference to the amount of detected skew of the long-size paper 5*a*.

Figure 13:
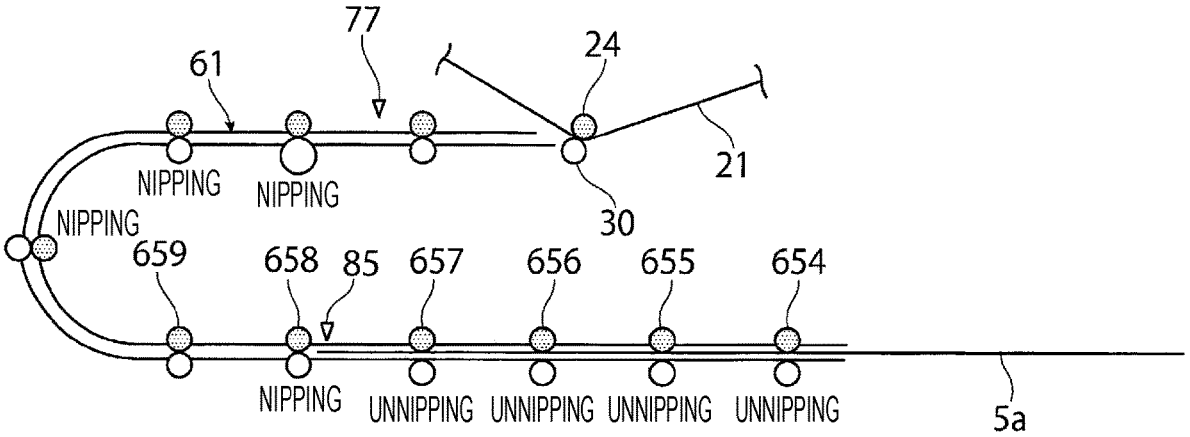
FIG. 13 illustrates another state of transport of the long-size paper in the paper transporting device according to the exemplary embodiment of the present disclosure.

This state of the paper transporting device 60 is illustrated in FIG. 13, where the pair of paper transporting rolls 658 is nipping the long-size paper 5*a* while the pairs of paper transporting rolls 651 to 657 located on the upstream side relative to the pair of paper transporting rolls 658 are all in the unnipping position.

More specifically, the paper transporting device 60 is in the state illustrated in FIG. 9, where the second eccentric portions 912 and 922 of the first and second eccentric cams 91 and 92 are positioned in contact with the first and second cam followers 931 and 941. Therefore, the pair of paper transporting rolls 658 is in the nipping position while the pair of paper transporting rolls 657 is in the unnipping position. Furthermore, the pairs of paper transporting rolls 651 to 656 located on the upstream side relative to the pair of paper transporting rolls 657 are all in the unnipping position.

Figure 14:
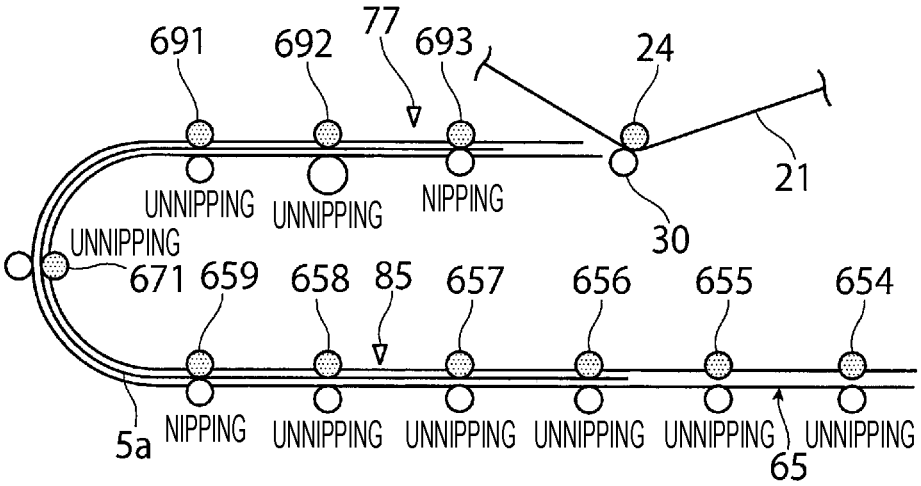
FIG. 14 illustrates yet another state of transport of the long-size paper in the paper transporting device according to the exemplary embodiment of the present disclosure.

Subsequently, as illustrated in FIG. 14, the control device 100 controls the pair of paper transporting rolls 658 to transport the long-size paper 5*a* to the paper feeding path 61. In this process, the long-size paper 5*a* is stopped when the leading end thereof reaches a position past the pair of paper transporting rolls 693 in the paper feeding path 61.

Then, in the paper transporting device 60, the long-size paper 5*a* is nipped by only the pair of paper transporting rolls 659 and the pair of paper transporting rolls 693 while the other pairs of paper transporting rolls are in the unnipping position.

This state of the paper transporting device 60 is illustrated in FIG. 10, where the third eccentric portions 913 and 923 of the first and second eccentric cams 91 and 92 are positioned in contact with the first and second cam followers 931 and 941. Therefore, the pair of paper transporting rolls 658 and the pair of paper transporting rolls 657 are both in the unnipping position.

To summarize, in the paper transporting device 60 according to the present exemplary embodiment, the single switching mechanism 90 including the first and second eccentric cams 91 and 92 is capable of switching the state of nipping by the pair of paper transporting rolls 658 and the pair of paper transporting rolls 657 located adjacent to each other in the direction of transport of the recording paper 5 between the state where the two are both in the nipping position, the state where the pair of paper transporting rolls 658 is in the nipping position while the pair of paper transporting rolls 657 is in the unnipping position, and the state where the pair of paper transporting rolls 658 and the pair of paper transporting rolls 657 are both in the unnipping position.

The above exemplary embodiment relates to a case where the single switching mechanism 90 is applied to the pairs of paper transporting rolls 658 and 657 provided to the duplex transport path 65. The application of the single switching mechanism 90 is not limited to such a case. The single switching mechanism 90 may be applied to the pairs of paper transporting rolls 692 and 693 provided to the paper feeding path 61 or to other pairs of paper transporting rolls.

The above exemplary embodiment relates to an image forming apparatus configured to form a full-color image. The application of the exemplary embodiment is not limited to such a case. The above exemplary embodiment may be applied in the same way to an image forming apparatus configured to form a monochrome image.

The above exemplary embodiment relates to a case where the sheet transporting device is applied to a paper transporting device intended for an image forming apparatus. The application of the sheet transporting device is not limited to such a case. The sheet transporting device may be applied in the same way to a device intended for any apparatus other than the image forming apparatus, as long as the device is configured to transport a sheet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet transporting device comprising:

a plurality of pairs of transporting rolls that are arranged adjacent to one another in a direction of transport of a sheet;

an additional pair of transporting rolls downstream, in the direction of transport of the sheet, of the plurality of pairs of transporting rolls; and a single switching mechanism configured to switch individual positions of the plurality of pairs of transporting rolls between a nipping position and an unnipping position, the single switching mechanism being configured to switch a state of nipping by the plurality of pairs of transporting rolls between all of the plurality of pairs of transporting rolls are in the nipping position, some of the plurality of pairs of transporting rolls are in the nipping position while remaining ones of the plurality of pairs of transporting rolls are in the unnipping position, and all of the plurality of pairs of transporting rolls are in the unnipping position, wherein the single switching mechanism includes:

a plurality of eccentric cams that are coaxial, an arm that is in contact with some of the plurality of eccentric cams and is configured to displace the some of the pairs of transporting rolls between the nipping position and the unnipping position, and another arm that is in contact with remaining ones of the plurality of eccentric cams and is configured to displace the remaining ones of the pairs of transporting rolls between the nipping position and the unnipping position; and the additional pair of transporting rolls are configured to correct a position of the sheet in a direction intersecting the direction of transport of the sheet after skew is corrected by one pair of the plurality of pairs of transporting rolls.

2. The sheet transporting device according to claim 1, wherein the plurality of eccentric cams include:

respective first cam portions configured to displace all of the plurality of pairs of transporting rolls to the nipping position;

respective second cam portions configured to displace the some of the plurality of pairs of transporting rolls to the nipping position while displacing the remaining ones of the plurality of pairs of transporting rolls to the unnipping position; and respective third cam portions configured to displace all of the plurality of pairs of transporting rolls to the unnipping position.

3. An image forming apparatus comprising:

an image forming component configured to form an image on a recording medium; and a transporting component configured to transport the recording medium to the image forming component, wherein the transporting component includes the sheet transporting device according to claim 2.

4. The sheet transporting device according to claim 1, wherein the single switching mechanism includes:

a first eccentric cam configured to displace one of the plurality of pairs of transporting rolls; and a second eccentric cam configured to displace another of the plurality of pairs of transporting rolls.

5. The sheet transporting device according to claim 4, wherein the single switching mechanism includes a single driving shaft to which the first eccentric cam and the second eccentric cam are attached.

6. An image forming apparatus comprising:

an image forming component configured to form an image on a recording medium; and a transporting component configured to transport the recording medium to the image forming component, wherein the transporting component includes the sheet transporting device according to claim 5.

7. An image forming apparatus comprising:

an image forming component configured to form an image on a recording medium; and a transporting component configured to transport the recording medium to the image forming component, wherein the transporting component includes the sheet transporting device according to claim 4.

8. An image forming apparatus comprising:

an image forming component configured to form an image on a recording medium; and a transporting component configured to transport the recording medium to the image forming component, wherein the transporting component includes the sheet transporting device according to claim 1.

* * * * *